United States Patent [19]

McLaughlin et al.

[11] Patent Number: 5,014,875

[45] Date of Patent: May 14, 1991

[54] MEDICATION DISPENSER STATION

[75] Inventors: Carol F. McLaughlin, San Diego; Ronald R. Taylor, Rancho Santa Fe; William D. Williams, Solana Beach; Patrick M. Steusloff, San Diego, all of Calif.

[73] Assignee: Pyxis Corporation, San Diego, Calif.

[21] Appl. No.: 317,640

[22] Filed: Mar. 1, 1989

[51] Int. Cl.[5] ..... G07F 11/00

[52] U.S. Cl. ..... 221/2; 221/7; 221/69; 221/122; 221/154; 364/413.02; 364/479

[58] Field of Search ..... 221/2, 3, 5, 7, 15, 221/69, 76, 82, 122, 281, 154; 364/403, 413.02, 479; 312/209; 70/78, 81, 82, 87

[56] References Cited

U.S. PATENT DOCUMENTS

| | | | |
|---|---|---|---|
| D. 280,132 | 8/1985 | McLaughlin . | |
| 2,792,147 | 5/1957 | Stewart . | |
| 3,744,672 | 7/1973 | Dangles et al. . | |
| 3,762,601 | 10/1973 | McLaughlin . | |
| 3,998,356 | 12/1976 | Christensen | 221/2 |
| 4,113,098 | 5/1977 | Howard . | |
| 4,207,992 | 6/1980 | Brown . | |
| 4,267,942 | 5/1981 | Wick, Jr. et al. . | |
| 4,504,153 | 3/1985 | Schollmeyer et al. . | |
| 4,512,500 | 4/1985 | Belbin . | |
| 4,572,403 | 2/1986 | Benaroya . | |
| 4,573,606 | 3/1986 | Lewis et al. . | |
| 4,635,053 | 1/1987 | Banks et al. | 222/2 |
| 4,674,651 | 6/1987 | Sciomore et al. | 221/3 |
| 4,695,954 | 9/1987 | Rose et al. . | |
| 4,717,042 | 1/1988 | McLaughlin . | |
| 4,747,514 | 5/1988 | Stone . | |
| 4,785,969 | 11/1988 | McLaughlin . | |
| 4,811,764 | 3/1989 | McLaughlin | 221/3 |
| 4,847,764 | 7/1989 | Halvorson | 221/2 X |

FOREIGN PATENT DOCUMENTS

| | | | |
|---|---|---|---|
| 2205306 | 12/1988 | United Kingdom | 221/3 |

*Primary Examiner*—Joseph E. Valenza
*Assistant Examiner*—Boris Milef
*Attorney, Agent, or Firm*—Kelly, Bauersfeld & Lowry

[57] ABSTRACT

An improved medication dispenser station is provided for controlled access storage of medications and other pharmaceuticals in a medical facility, such as a hospital or the like. The dispenser station comprises a housing with a plurality of normally locked drawers which have been preloaded with selected pharmaceutical items. A control unit on the housing is programmed to unlock the drawers one at a time to permit access to the contents thereof, with such access being contingent upon keyboard entry of a predetermined access code and other selected information sufficient to generate an access record. In a preferred form, each drawer includes multiple compartments containing multiple pharmaceutical items in a presorted array. One or more of the drawers desirably includes a multicompartment carousel tray which rotates in response to appropriate data entry via the keyboard to align and lock a designated compartment for access through an access opening in an overlying cover plate, thereby restricting access to a single compartment of the rotatable tray.

25 Claims, 8 Drawing Sheets

FIG. 1
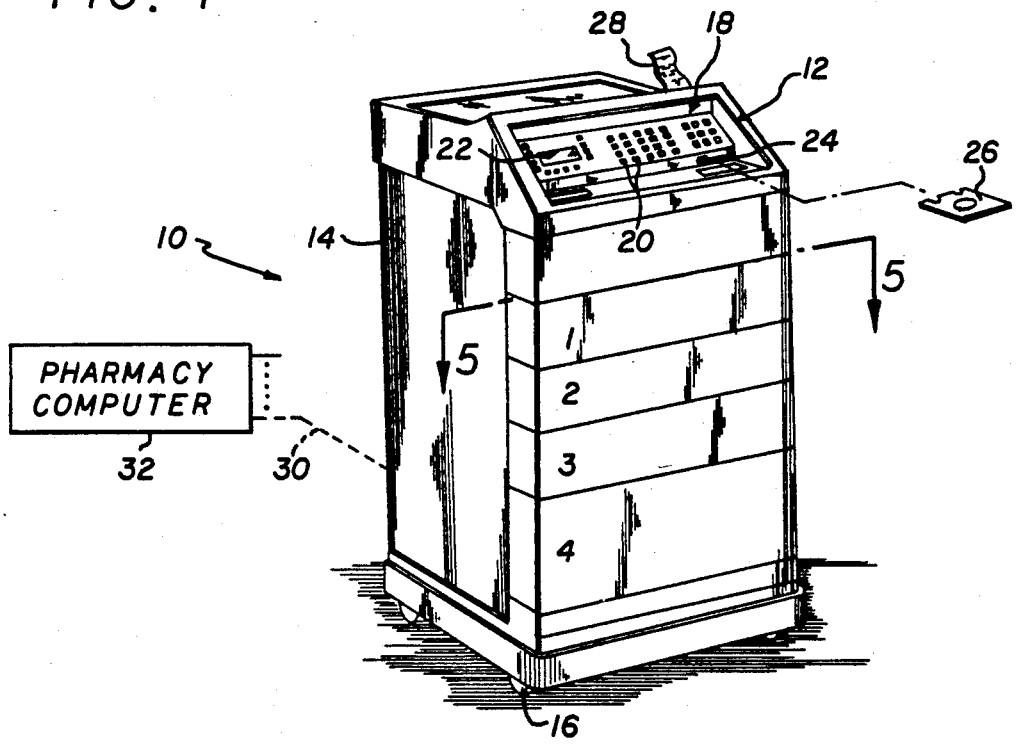
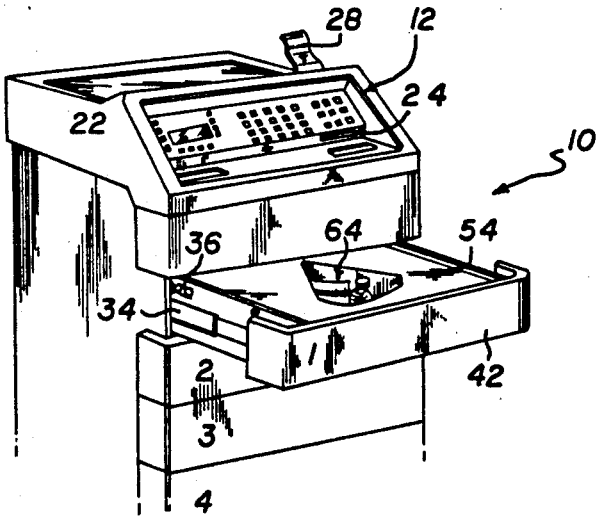
FIG. 2

FIG. 3
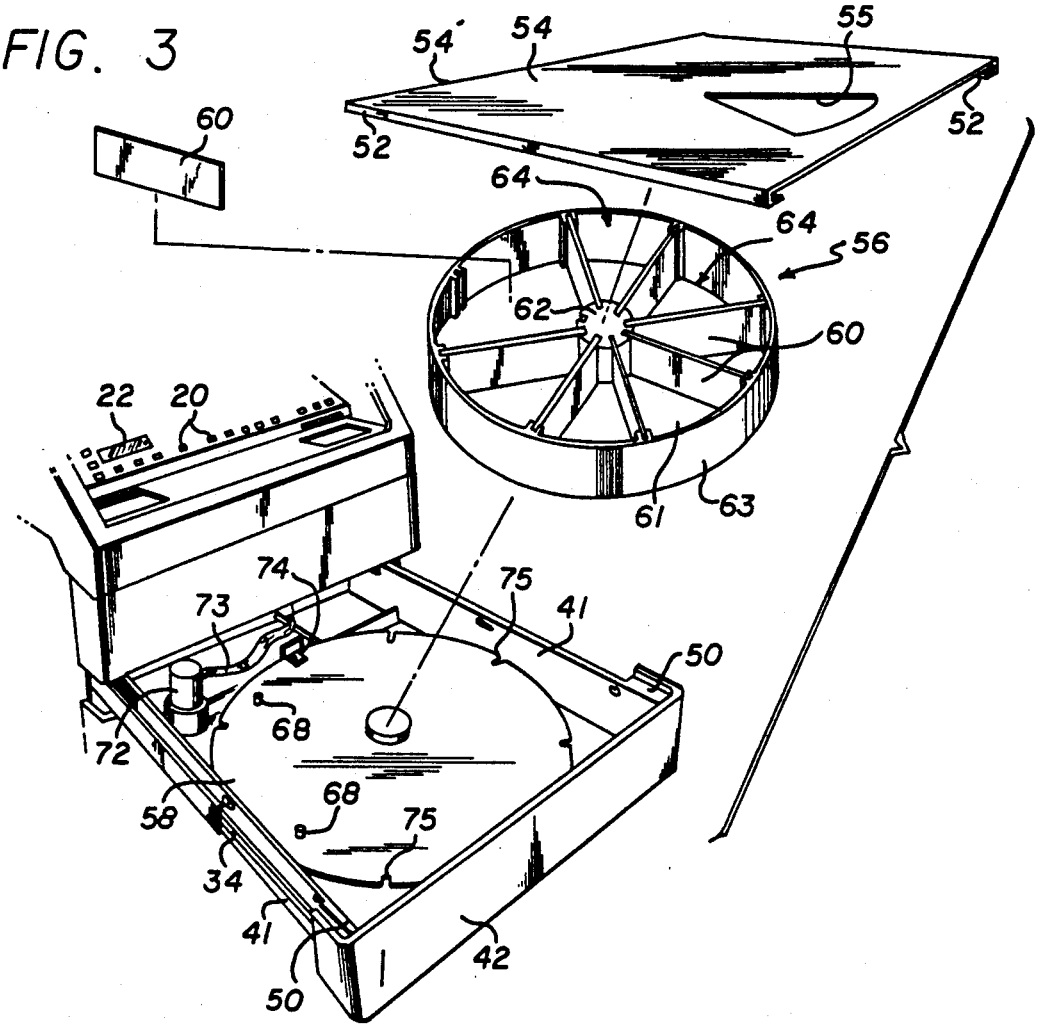
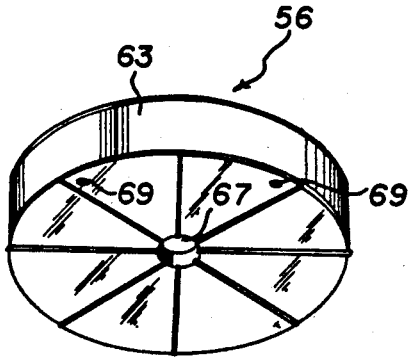
FIG. 4

FIG. 8
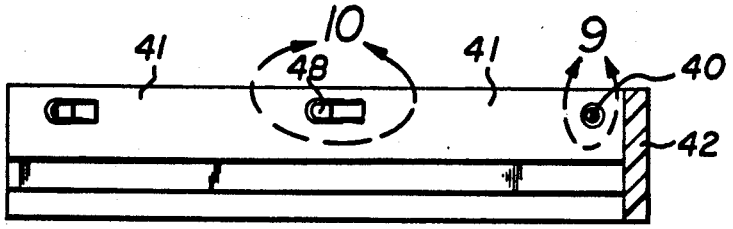
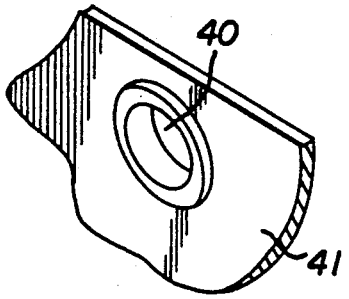
FIG. 9
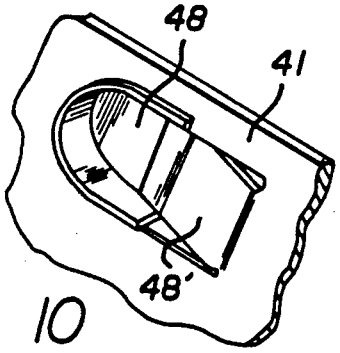
FIG. 10
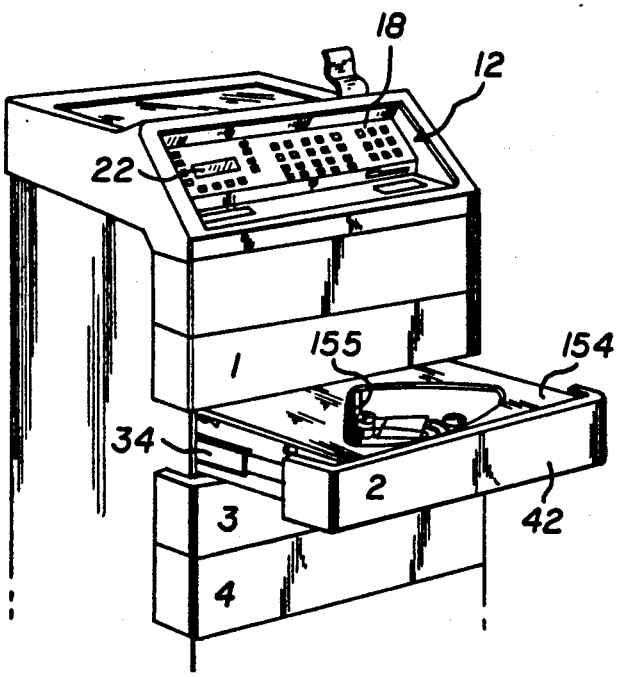
FIG. 11

FIG. 12
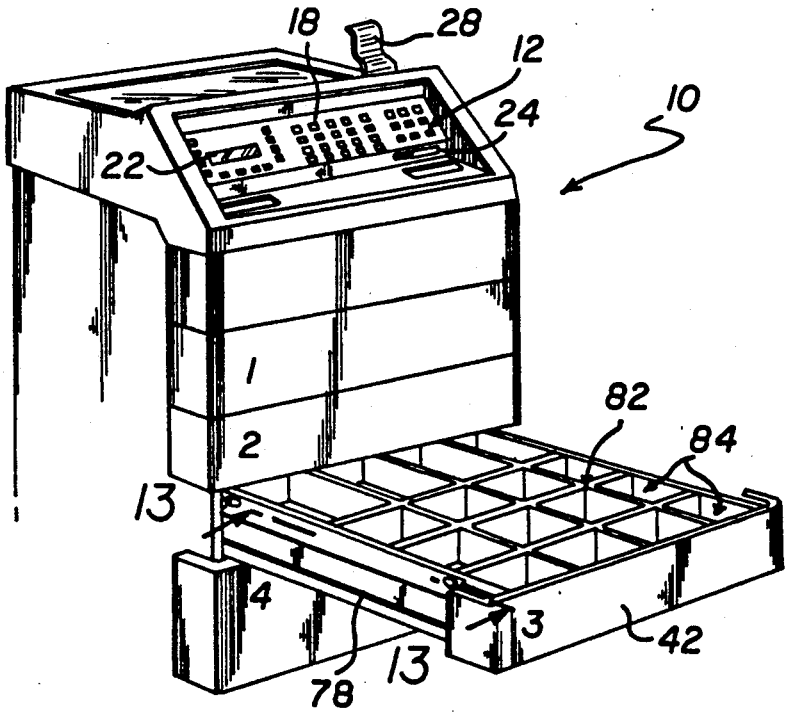
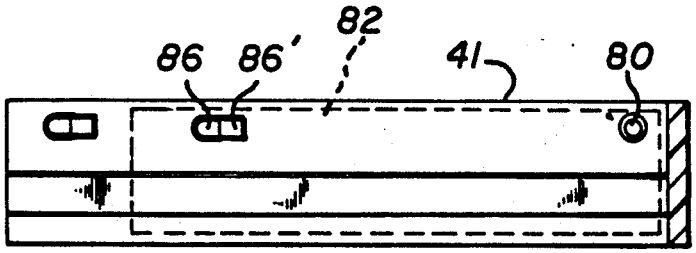
FIG. 13

FIG. 14
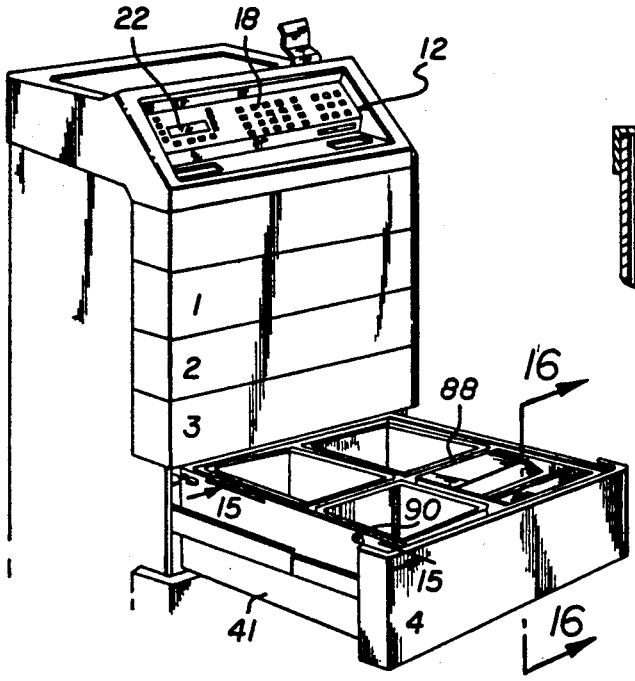
FIG. 16
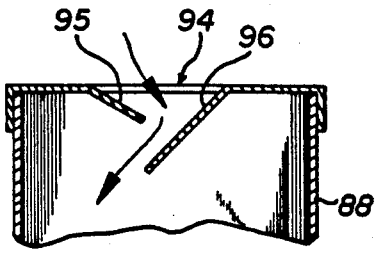
FIG. 15
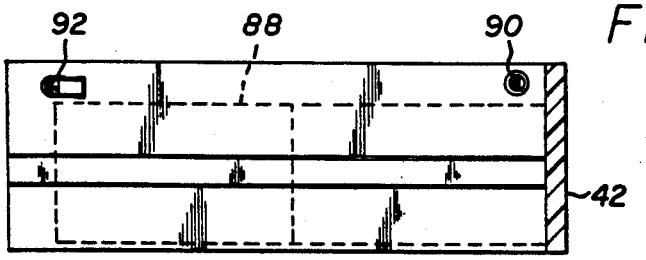
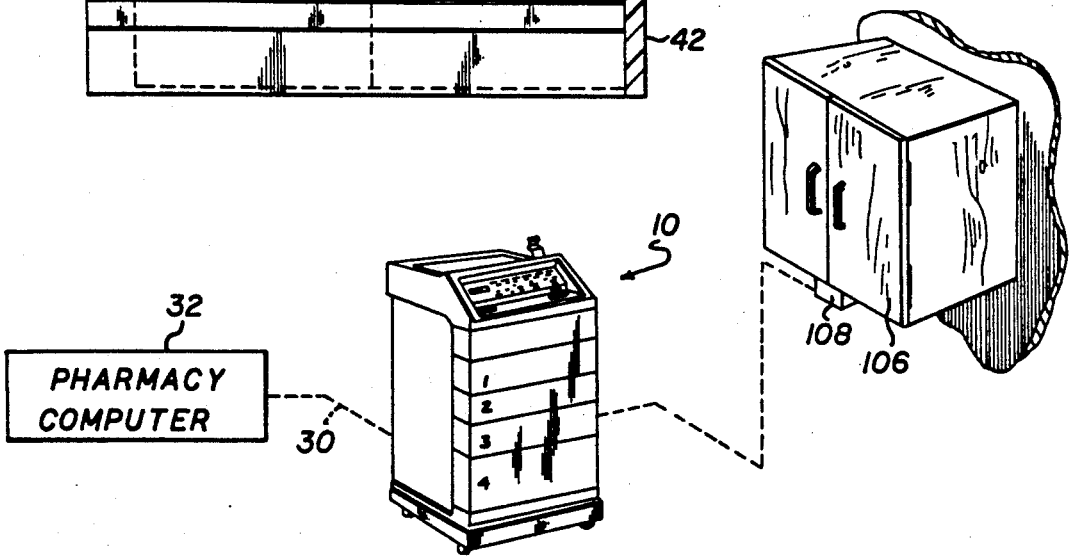
FIG. 18

MEDICATION DISPENSER STATION

BACKGROUND OF THE INVENTION

This invention relates generally to devices and systems for controlled dispensing of medications and other pharmaceutical items in a hospital environment or nursing home or the like. More particularly, this invention relates to an improved medication dispenser station and related method of operation for providing relatively simple yet controlled access to a wide range of pharmaceutical items, concurrently with generation and maintenance of an accurate, detailed access record.

In a hospital environment or the like, a large number of pharmaceutical items such as medications, syringes, dressings, etc. are used in the course of individualized medical treatment provided to multiple patients. Such pharmaceutical items are normally stocked at a centralized location in a hospital pharmacy for periodic distribution to nursing stations or the like located throughout the hospital facility. Such distribution of pharmaceutical items is tailored to the specific needs of each nursing station, particularly with respect to the individual medical treatment requirements for patients assigned to each nursing station. For example, many medications are typically prescribed by physicians for administration to specific patients according to a particular time schedule. Other medications and pharmaceutical items are normally stocked at the nursing station for use on an as needed basis.

At each nursing station, the pharmaceutical items are stored for access by nursing personnel in accordance with individual patient requirements. In this regard, many items are normally maintained in unlocked storage for easy and substantially unrestricted access, while other items such as narcotic medications are normally retained in locked storage to prevent unauthorized access and theft. For all pharmaceutical items, however, withdrawal of pharmaceutical items from inventory is accompanied by updating of the medication administration record (MAR) for the appropriate patient. In this regard, such record maintenance is an important function of nursing personnel to confirm the treatment regimen for each patient, to insure proper charging of patient accounts, and to permit accurate tracking of the pharmaceutical inventory. Unfortunately, due to the exigencies of a typical nursing environment, the medication records are often incomplete and/or inaccurate. As a result, the inventory of some or all of the pharmaceutical items is regularly checked, such as at the conclusion of each nursing shift, in an effort to reduce recording and/or treatment errors and further to minimize pilferage losses.

In recent years, a variety of devices and systems have been proposed in attempts to provide improved inventory control for pharmaceutical items in a hospital environment or the like. Many such devices have contemplated individual medication dispensers located at bedside in association with individual patients. However, the use of multiple bedside dispensers can be relatively costly and further requires regular manual attention to ensure proper loading and individualized programming for each patient. Other systems have envisioned centralized units at a nursing station or the like for maintaining different medications and related pharmaceutical items under locked storage. While such centralized units have provided improved safety and enhanced record keeping for narcotic substances, such units have unduly restricted access to many routine pharmaceutical items. Accordingly, prior centralized medication units have not met with commercial acceptance on any significant scale.

There exists, therefore, a significant need for an improved medication dispenser station designed for storage of a wide range of pharmaceutical items at a centralized location in a medical facility, wherein those pharmaceutical items are relatively easily accessed by authorized personnel in a manner which generates and maintains accurate access records. The present invention fulfills these needs and provides further related advantages.

SUMMARY OF THE INVENTION

In accordance with the invention, an improved medication dispensing station comprises a housing having a plurality of drawers for normally locked storage of pharmaceutical items. A control unit on the housing is programmed upon keyboard entry of a predetermined access code to unlock the drawers one at a time, thereby permitting controlled access to the contents of the drawer. The control unit functions to generate and store an access record.

In the preferred form of the invention, each drawer includes multiple compartments for containing a variety of pharmaceutical items arranged in presorted array. The drawers are normally locked to prevent access to the contents thereof. The control unit incorporates keyboard entry means to permit entry of an authorized access code in combination with patient and pharmaceutical item designation. Upon entry of such information, the drawer containing the designated pharmaceutical item is unlocked to permit the pharmaceutical item to be removed and used. The unlocked drawer is then reclosed and relocked, whereupon the control unit generates a detailed access record specifying, for example, the date and time, the patient, the designated pharmaceutical item, and the identification of the nurse or other person accessing the pharmaceutical item. The generated access record can be stored in memory, transmitted to a central computer, and/or printed as paper copy.

One or more of the station drawers desirably includes a rotatable carousel tray having multiple compartments for receiving different pharmaceutical items. Upon entry of appropriate information designating a pharmaceutical item within a particular tray compartment, the control unit rotates the tray to align and lock the designated compartment with an access opening in an overlying cover plate. The drawer is then unlocked and opened to permit limited access to the designated compartment of the carousel tray.

The carousel tray is conveniently constructed with removable partitions dividing adjacent tray compartments of generally pie-shaped geometry. With this construction, the relative sizes of the tray compartments can be customized according to the sizes and shapes of the particular pharmaceutical items to be contained therein. An appropriate cover plate with an access opening of corresponding size and shape is used.

The control unit is programmed to permit and record operation in a normal use mode or in a station restocking mode. For example, in a normal use mode, the control unit responds to a standard authorized access code to permit partial opening of drawers having carousel trays for access to designated compartments, without permitting cover plate removal. Alternately, upon entry of a predetermined restock access code, such drawers may be fully opened in a manner permitting removal of the cover plate to expose all compartments of the carousel tray for restocking purposes.

In accordance with further aspects of the invention, one or more of the compartments in a selected drawer may include a return receptacle designed to receive unused pharmaceutical items. Such receptacle conveniently includes an apertured cap adapted for one way reception of unused pharmaceutical items, while substantially preventing manual retrieval of items dropped through the cap. Additionally, the control unit may be coupled to operate auxiliary lock apparatus associated with one or more an auxiliary cabinets within which additional pharmaceutical items may be stored.

Other features and advantages of the invention will be more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is front perspective view illustrating a medication dispenser station embodying the novel features of the invention;

FIG. 2 is an enlarged fragmented perspective view of a portion of the medication dispenser station, and depicting one drawer in an open position for access to the contents thereof;

FIG. 3 is a further enlarged and exploded perspective view depicting construction details of the open drawer shown in FIG. 2;

FIG. 4 is a bottom perspective view of a carousel tray used in the drawer of FIGS. 2 and 3;

FIG. 8 is a side elevation view taken generally on the line 8—8 of FIG. 5;

FIG. 9 is an enlarged fragmented perspective view corresponding with the encircled region 9 of FIG. 8;

FIG. 10 is an enlarged fragmented perspective view corresponding with the encircled region 10 of FIG. 9;

FIG. 11 is a fragmented front perspective view similar to FIG. 2, but depicting an alternative drawer in an open position;

FIG. 12 is another fragmented perspective view similar to FIGS. 2 and 11, but showing still another drawer of the dispenser station in an open position:

FIG. 13 is an enlarged side elevational view taken generally on the line 13—13 of FIG. 12;

FIG. 14 is a fragmented perspective view similar to FIGS. 2, 11 and 12, but depicting a large lower drawer of the dispenser station in an open position;

FIG. 15 is an enlarged side elevational view of the lower drawer, taken generally on the line 15—15 of FIG. 14;

FIG. 16 is a fragmented vertical sectional view taken generally on the line 16—16 of FIG. 14;

FIG. 18 is a somewhat schematic and fragmented perspective view illustrating alternative operation of the dispenser station in coordination with auxiliary storage devices.

DETAILED DESCRIPTION OF THE PREFERRED EMBODIMENT

Figure 1A:
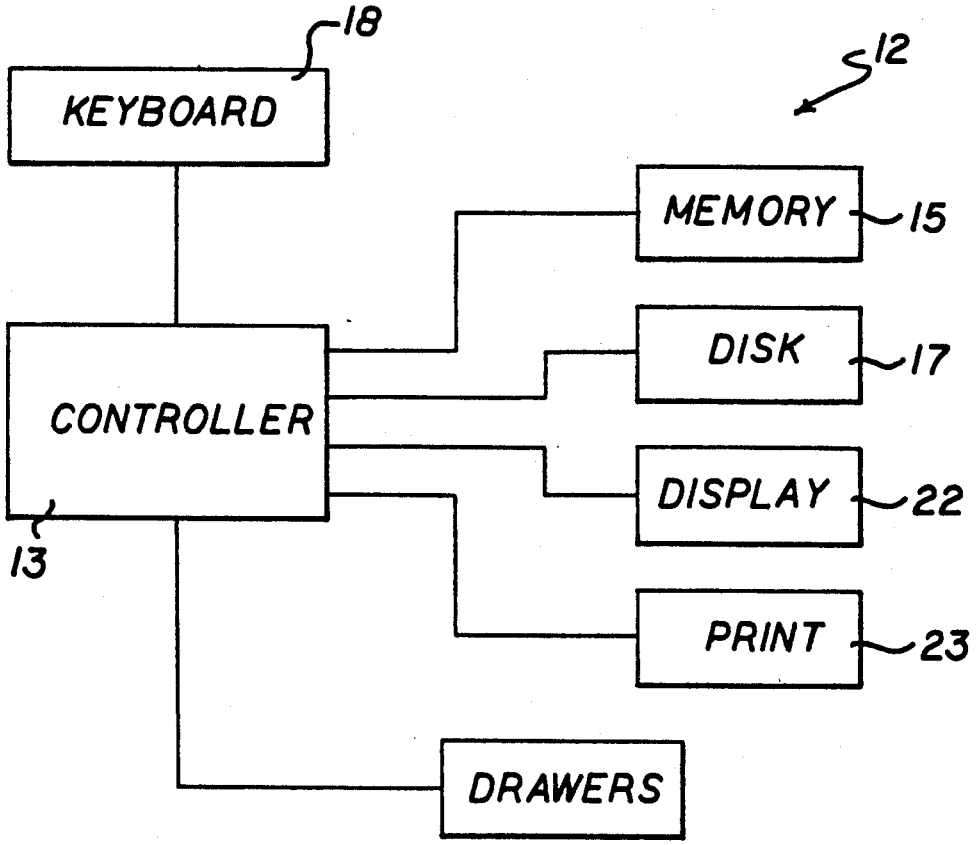
FIG. 1A is a schematic diagram depicting elements of a station control unit.

As shown in the exemplary drawings, a medication dispenser station referred to generally by the reference numeral 10 is provided for controlled access to a plurality of pharmaceutical items and the like contained therein. The dispenser station 10 includes a control unit 12 which is programmed for relatively quick and easy access to one or more designated pharmaceutical items stocked within a plurality of normally closed and locked drawers. The control unit 12 is designed for relatively simple keyboard entry of appropriate authorization access codes and other information sufficient to create an accurate and detailed access record.

The medication dispenser 10 of the present invention is designed for inventory control of a selected large number of pharmaceutical items such as prescription and nonprescription medications, syringes and other fluid infusion apparatus, bandages and other dressings, etc. The station 10 includes a plurality of the normally locked drawers, each of which is constructed with multiple compartments for receiving and storing a plurality of pharmaceutical items in a presorted array for easy access. These drawers may be designed in different configurations to provide variable ease of access tailored to the particular type or types of items stocked therein. That is, one or more of the drawers can be adapted for greater restriction to access for certain items such as narcotic medications and the like, whereas other drawers can be constructed for greater ease of access to routine items, such as aspirin, cotton swabs, etc. In all cases, however, the control unit 12 requires entry of sufficient authorization code and other data appropriate to the pharmaceutical item being accessed to create and store a thorough, accurate access record.

The medication station is particularly designed for use in a hospital environment or the like, in association with a number of patients requiring pharmaceutical items stored in station inventory. In this regard, a typical environment of use is in conjunction with a centralized nursing station on a hospital floor or ward. In a preferred form, the station 10 is designed to stock an inventory of pharmaceutical items selected to meet the anticipated requirements of up to about twenty-five patients. However, it will be understood that the patient capacity can be varied by appropriate modification to include additional stock drawers, as required.

The illustrative dispenser station 10 as viewed in FIG. 1 comprises a compact housing 14 which may be supported on wheels 16 for convenient portability. The control unit 12 is mounted generally within the upper extent of the housing and includes appropriate computerized memory component of a type generally well known to those skilled in the art, in association with a compact keyboard 18 in a position exposed for easy access. The keyboard 18 permits manual entry and/or readout of a wide range of information in the course of station operation, as will be described, in accordance with a particular program utilized with the control unit. More specifically, the keyboard includes an array of keys 20 or similar entry devices for entering information, in conjunction with a display 22 which utilizes liquid crystal elements or the like in programmed interaction with entered information. FIG. IA depicts the controller unit in schematic form with the keyboard 18 for information entry to a controller 13. As will be described, the controller 13 is programmed to regulate access to the station drawers, and to generate an access record which is stored in internal memory 15, or recorded via a disk drive unit 17 having an exposed disk port 24 (FIG. 1) to receive a conventional floppy disk 26. Alternately, the access record can be displayed on the station display 22 and/or otherwise printed by means of an integral printer unit 23 for appropriate printout onto paper tape 28 (FIG. 1).

The control unit 12 is preprogrammed with appropriate information regarding the medication types and schedules associated with a group of patients assigned to the dispenser station 10. In a preferred form, this preprogramming occurs by virtue of a data link 30 which interconnects the station 10 to a main computer such as a pharmacy computer 32 (FIG. 1) of the type used commonly in a centralized hospital pharmacy to track patient requirements for medication and other pharmaceutical items. In this regard, the pharmacy computer 32 desirably includes appropriate software for programming and updating a group of the dispenser stations 10 located at centralized sites throughout a hospital facility, thereby permitting regular updating of each dispenser station according to the most current patient information. Such updated information includes medication data together with nonmedical data regarding patient admissions, location, transfers and discharges by appropriate entry into the pharmacy computer, or by linking the pharmacy computer in turn to a main hospital data base having such information stored therein. Alternatively, if desired, the control unit 12 of the dispenser station can be adapted for individualized programming via use of the keyboard 18.

Upon keyboard entry of appropriate information into the control unit 12, the control unit unlocks a selected one of the station drawers to permit access to one or more pharmaceutical items contained therein. Such input information will typically include, for example, an authorization access code unique to the nurse or other person utilizing the dispenser station. Additional background information such as time and date may also be entered, or otherwise automatically recorded upon entry of an active access code. Importantly, additional information such as patient identification and the designated pharmaceutical item or items are also entered. For facilitated operation, this data entry is conveniently performed in response to menu prompts which appear on the display 22. When a complete set of desired data is entered, the control unit 12 functions to unlock the particular drawer containing the designating pharmaceutical item for access and withdrawal of that item from station inventory. The display 22 may include an appropriate prompt identifying the drawer in which the designated item is contained.

The exemplary drawings illustrate the dispenser station 10 including a stack of four drawers labeled "1" through "4" for ease of identification. As will be described, these drawers may have the same or different constructions according to the customized requirements and desires of a particular medical facility. Moreover, it will be understood that the number of drawers can be varied as needed to provide the appropriate station inventory capacity.

As shown in FIGS. 2 and 3, the upper drawer "1" has a generally conventional drawer geometry and is mounted on slides 34 for opening movement with respect to the station housing 14. The drawer is normally closed and locked by means of a pair of locking solenoids 36 (FIGS. 5–7) having plungers 38 advanced for reception into aligned circular lock ports 40 (FIGS. 8 and 9) formed in the side walls 41 of the drawer. These locking solenoids 36 are mounted on the inboard sides of the station housing 14 and are generally concealed when the drawer is open or closed. A drawer front 42 includes side edges wrapping partially about the housing front.

The drawer "1" is unlocked by the control unit 12 for access to the drawer contents by retracting the solenoid plungers 38 from the lock ports 40 in the drawer side walls 41. When this occurs, a compressed drawer spring 43 expands to displace the drawer "1" toward a partially opened position, as viewed in FIG. 7. Accordingly, momentary retraction of the solenoid plungers 38 is sufficient to unlock the drawer. In this regard, the spring 43 is carried about a guide rod 44 having its rearward end abutted with a back wall 45 of the station housing when the drawer is closed and locked. In this position, the drawer spring 43 is compressed between a rear wall 46 of the drawer "1" and a retainer ring 47 on the guide rod 44. However, when the locking solenoids are momentarily actuated to retract their plungers 38, the drawer spring 43 expands to displace the entire drawer "1" along its drawer slides 34 to a partially opened position. The drawer front 42 may then be easily grasped and manually withdrawn to a further open position. In a normal operating mode for dispensing of medications and other pharmaceutical items, such further opening of the drawer "1" is halted by reception of the solenoid plungers 38 into intermediate lock ports 48 when the drawer is opened approximately half-way. These intermediate lock ports 48 (FIGS. 8 and 10) conveniently include ramped forward edges 48' for guiding the solenoid plungers 38 into the open ports, and to permit unimpeded drawer reclosure at any time.

The drawer side walls 41 include intermittent flanges 50 formed along their upper margins for interlocking with mating side flanges 52 of a drawer cover plate 54, as shown in FIGS. 2 and 3. These interlocking sets of flanges 52 and 54 are shaped to prevent removal of the cover plate 54 when the drawer is opened to the intermediate, approximate half-way position as viewed in FIG. 2. However, when the drawer is fully opened as will be described (FIG. 3), a rear edge 54' of the cover plate 54 is exposed to permit manual disengagement of the interlocking flanges for cover plate removal.

The cover plate 54 is formed with a generally pie-shaped access opening 55 to permit limited access to the contents of the drawer "1". In this regard, the cover plate 54 overlies a carousel tray 56 supported on a rotatable turntable 58 within the interior of the drawer "1". The carousel tray 58 includes a plurality of radially extending dividers 60 which cooperate with a tray floor 61, hub 62 and peripheral wall 63 to define a plurality of generally pie shaped compartments 64 which correspond in size and shape with the cover plate access opening 55. The control unit 12 responds to appropriate input data via the keyboard 18 to rotate the turntable 58 and align a selected one of the tray compartments 64 with the access opening 55, thereby permitting restricted or limited access to a single tray compartment. Lock means prevents tray rotation when the drawer is open, thereby preventing access to the other tray compartments.

As shown in FIGS. 3–7, the turntable 58 comprises a generally circular platter having a central hub 65 supported for rotation on a bearing 66 within the drawer "1". The turntable hub 65 is adapted to seat within a mating lower cavity 67 formed in the underside of the tray hub 62 (FIG. 4). In addition, at least one and preferably two drive pegs 68 project upwardly from the turntable 58 for registry with mating recessed seats 69 formed in the underside of the tray floor 61. Accordingly, rotationally driving of the turntable 58 is coupled to the carousel tray 56.

Figure 5:
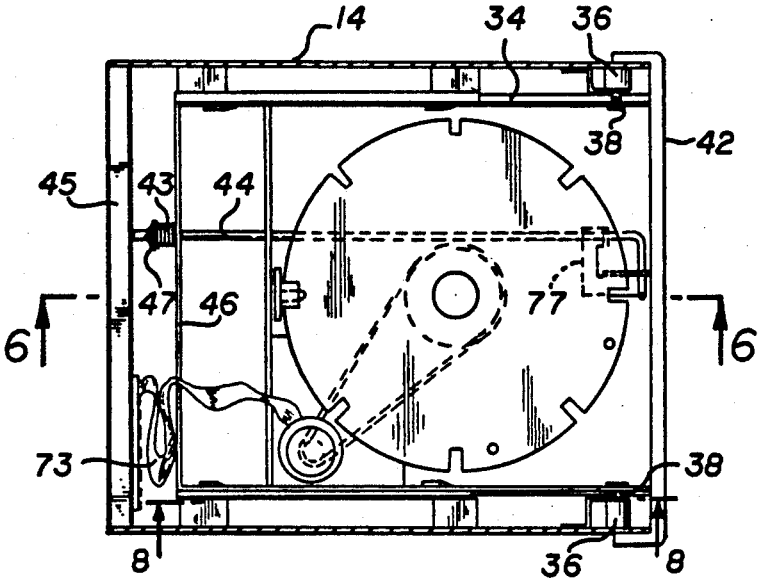
FIG. 5 is a horizontal sectional view taken generally on the line 5—5 of FIG. 1, and illustrating a drawer of the dispenser station in a closed and locked position.
Figure 7:
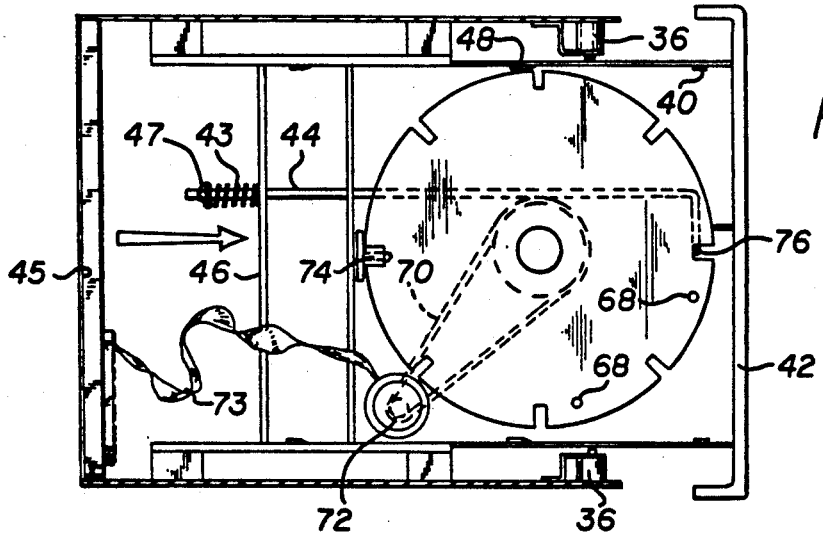
FIG. 7 is a sectional view similar to FIG. 5, but depicting the drawer in an open position.
Figure 6:
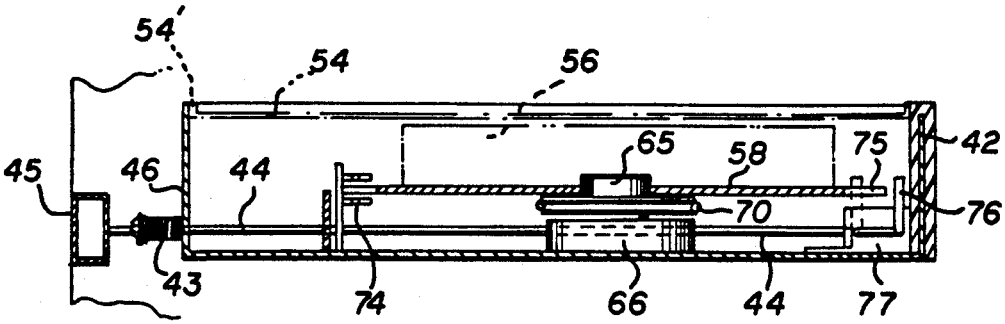
FIG. 6 is a longitudinal vertical sectional view taken generally on the line 6—6 of FIG. 5.

A drive belt 70 is interconnected between the turntable 58 and a drive motor 72, both of which are installed within the drawer "1", as viewed in FIGS. 5–7. The drive motor 72 is appropriately linked via a cable 73 to the control unit 12 for operating the turntable 58 in response to instructions entered via the keyboard 18. That is, while the drawer "1" is closed and locked, the drive motor 72 rotates the turntable 58 and carousel tray 56 to a selected position aligning a designated tray compartment 64 with the access opening 55. An optical detector 74 is conveniently provided to detect peripheral notches 75 in the turntable 58, thereby providing feedback indication of actual turntable rotational position.

When the drawer "1" is unlocked, the guide rod 44 provides convenient lock means preventing further turntable rotation to limit access to a single drawer compartment. More specifically, as shown in FIGS. 5–7, the guide rod 44 protrudes longitudinally within the drawer "1" beneath the turntable 58 toward the drawer front 42. A forward end of the guide rod 44 is bent or turned upwardly to define a lock pin 76 for seating into one of the turntable notches 75 when the drawer is unlocked and opened. This seating displacement occurs by virtue of the drawer spring 43 which displaces the guide rod 44 rearwardly through a short stroke to displace the lock pin 76 from the unlocked position (FIGS. 5 and 6) to a locked position (FIG. 7). A rod bracket 77 within the drawer assists in maintaining guide rod alignment for this longitudinal sliding displacement. When the drawer is reclosed and relocked, the rear end of the rod 44 engages the housing back wall 45 to displace the lock pin 76 forwardly and unlock the turntable.

Accordingly, with respect to the upper drawer "1", normal station operation requires entry of appropriate nurse and patient data in combination with a designation of the desired pharmaceutical item. In response to entering of such data, the control unit 12 rotates the carousel tray 56 to align a selected one of the drawer compartments 64 with the cover plate access opening 55. The control unit 12 then unlocks the drawer "1" to permit partial opening thereof, as viewed in FIG. 2, sufficiently to expose the access opening 55 and the underlying tray compartment 64. While the drawer is open, the tray 56 is locked against rotation to preclude access to other tray compartments. When the drawer is reclosed and locked, the control unit 12 responds by creating an appropriate record which can be stored on the disk 26, printed out on the paper tape 28, and/or transmitted via the data link 30 to the pharmacy computer 32.

The carousel tray 56 shown in FIGS. 2 and 3 is conveniently provided as a molded plastic structure having removable radial dividers 60 to permit variation in tray compartment size. More specifically, as viewed in FIG. 3, the dividers 60 are removably anchored between radially aligned sets of recesses on the hub 62 and peripheral wall 63. The illustrative tray is adapted to include a total of eight dividers 60, thereby dividing the tray 56 into eight pie-shaped compartments 64 of uniform size. Such compartments are sufficiently large to contain many pharmaceutical items particularly such as medications in tablet form or the like, wherein significantly restricted access is required. However, for larger pharmaceutical items, the tray 56 can be reconfigured to include fewer dividers 60 thereby creating larger tray compartments. Such reconfiguration is illustrated in FIG. 11 with respect to drawer "2", wherein the drawer "2" is identical with drawer "1" except that the carousel tray therein is reconfigured with four dividers 60 defining larger tray compartments for locked alignment beneath a quadrant pie-shaped access opening 155 in a modified cover plate 154.

FIGS. 12 and 13 illustrate an alternative drawer geometry with respect to drawer "3". As shown, the drawer "3" includes appropriate slides 78 which accommodate drawer opening when locking solenoids (not shown) are unlocked with respect to forward lock ports 80, in the same fashion as described with respect to drawer "1". However, the interior of the drawer "3" is subdivided by a partition grid 82 into a plurality of upwardly open compartments 84 of the same or variable shape. This grid 82 is conveniently formed as a unitary insert and may be provided in different geometries to provided different compartment numbers and configurations. When the drawer is unlocked and opened in response to appropriate data input via the keyboard 18, the compartments 84 are simultaneously exposed for easy access. In this regard, the drawer "3" is designed to stock relatively routine pharmaceutical items which do not require a high degree of restriction. When opened, intermediate lock ports 86 having ramped forward edges 86, are engaged by associated locking solenoids to prevent the drawer from being opened sufficiently to remove the grid 82. However, in comparison with drawers "1" and "2", the intermediate ports 86 associated with drawer "3" are located rearwardly to permit opening of the drawer to a greater extent.

FIGS. 14–16 show a further alternative drawer geometry with respect to drawer "4" of the dispenser station 10. As shown, the drawer "4" is relatively deeper in overall construction and is designed for removable reception of an array of bins 88 for receiving and stocking relatively large pharmaceutical items. The drawer "4" is normally locked and opened in the same manner as described with respect to drawers "1"–"3". Locking solenoids (not shown) are normally engaged with forward lock ports 90 to retain the drawer in a closed and locked position. However, those solenoid units can be actuated to unlock the drawer upon appropriate data entry, thereby permitting drawer opening to a fully opened position. Rearward lock ports 92 may be provided to provide a limit stop to drawer opening movement, and thereby prevent undesired removal of the drawer from the station housing 14.

As shown in FIG. 16, one of the bins 88 may be used as a return receptacle for unused pharmaceutical items. Such bin includes a one-way cap having an aperture 94 defined between partially overlapping cap walls 95 and 96. These cap walls thus cooperate to define a short maze through which pharmaceutical items can be dropped, substantially without opportunity to retrieve those pharmaceutical items.

Figure 17:
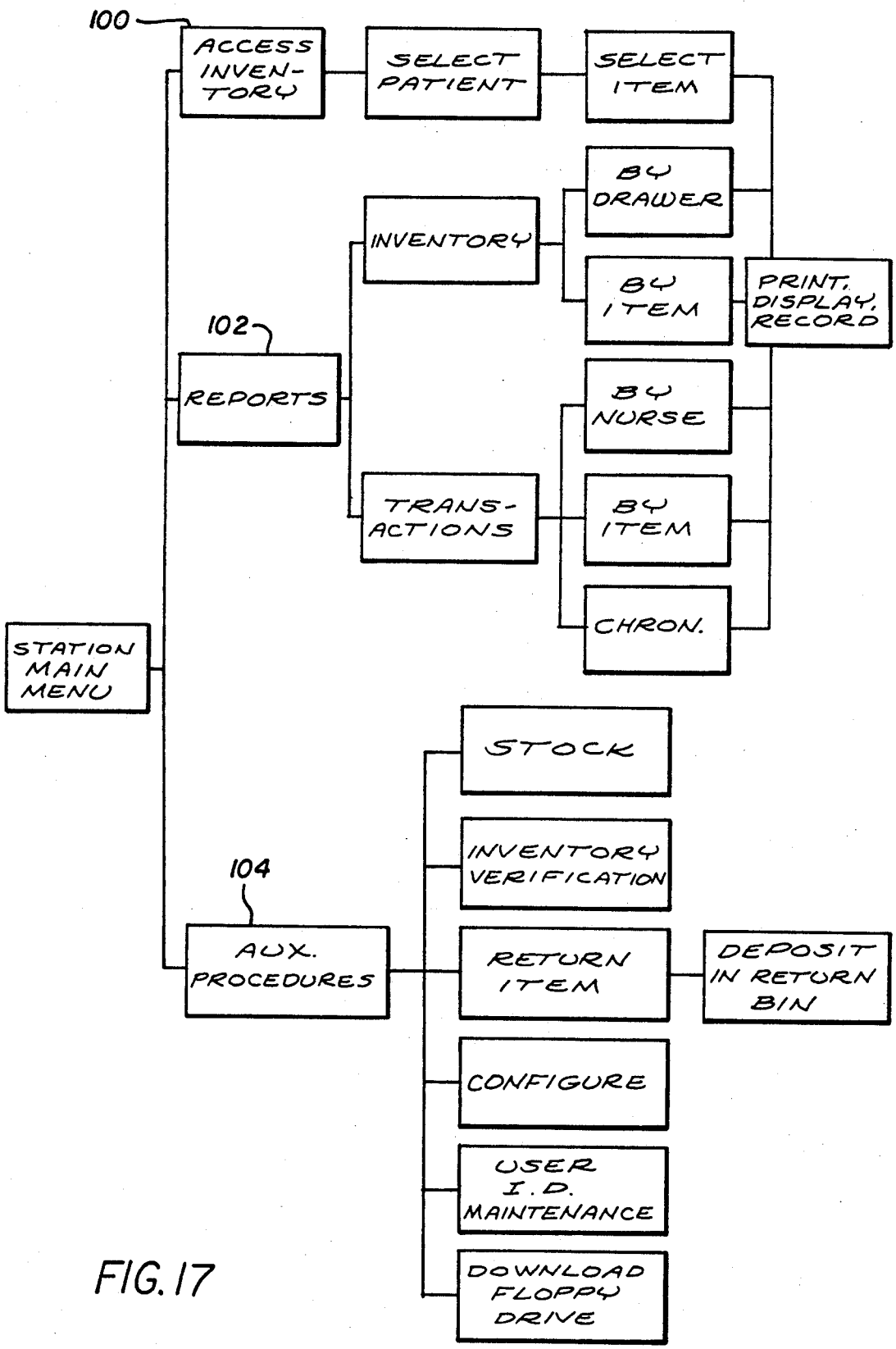
FIG. 17 is a flow chart illustrating programmed operation of the medication dispenser station of FIGS. 1–16.

FIG. 17 is a flow chart representing a preferred programming arrangement for the control unit 12 to operate the dispenser station 10 in a manner yielding the desired control and resultant access record.

More specifically, in a normal use mode, the keyboard 18 is appropriately accessed by entry of an authorized access code to permit removal of pharmaceutical items from the station inventory as represented by block 100. Entry of an approved access code permits further data entry for station operation. For example, with appropriate menu display prompts, the control unit can be operated to select a patient and a pharmaceutical item such as medication for administration to that patient, whereupon the appropriate drawer will open for medication access to permit removal from inventory. When the drawer is closed, the appropriate access record is created and can be printed, displayed, and/or recorded to disk or transferred to the main pharmacy computer.

Alternatively, periodic reports may be generated by the control unit following appropriate menu display prompts. Such reports may include current inventory reports, as represented in FIG. 17 by the block 102, by station drawer or by individual pharmaceutical item. Alternately, a transaction report can be generated in various forms to permit accurate tracking of station access. These reports may also be printed or displayed, etc.

As a further alternative to station operation, a variety of auxiliary procedures can be performed as represented at block 104. One primary alternate procedure comprises a stocking mode during which pharmacy personnel or the like may access the station drawers for restocking station inventory. For such access, the locking solenoids associated with the various drawers can be retained in retracted positions in response to entry of a special access code to permit full drawer opening. For those drawers carrying the carousel tray, such full drawer opening permits cover plate removal for simultaneous access to all drawer compartments.

Other auxiliary procedures may include inventory verification, or return of unused items to the return bin (FIG. 14). A configuration mode and/or an access code maintenance mode are also desirably provided to permit station set-up and entry of current approved access codes. In addition, a disk download mode is provided to obtain records recorded onto the floppy disk 26, for example, by reading the disk to the pharmacy computer.

The improved medication dispenser 10 of the present invention thus provides a versatile system for safe storage of a wide range of pharmaceutical items. The station accommodates relatively rapid and easy access to the pharmaceutical item by authorized personnel, in a manner consistently with and permitted generation of an accurate and detailed access record.

A variety of further modifications and improvements to the invention will be apparent to those skilled in the art. As one example, as viewed in FIG. 18, the station 10 can be linked to an auxiliary cabinet 106 within which additional pharmaceutical items are stored. The station 10 operates lock apparatus 108 associated with the cabinet 106 to provide restricted cabinet access while generating an accurate access record. Accordingly, no limitation of the invention is intended by way of the foregoing description and accompanying drawings, except as set forth in the appended claims.

What is claimed is:

1. A medication station, comprising:

a station housing;

a plurality of drawers carried by said station housing, each of said drawers being movable between an open position and a closed position, each of said drawers defining at least one compartment for containing a pharmaceutical item, said compartment being accessible to the exterior of the station housing when the drawer associated therewith is in the open position; and a control unit for selectively locking said drawers in the closed positions to prevent access to the drawer compartments, said control unit including keyboard entry means for entry of predetermined access data, lock means for selectively locking and unlocking said drawers, and controller means responsive to entry of said access data to selectively unlock at least one of said drawers while maintaining the remaining ones of said drawers in a locked condition to permit opening of said at least one of said drawers and access to the compartment defined thereby while preventing access to pharmaceutical items within said remaining ones of said drawers;

at least one of said drawers having a carousel tray mounted therein and defining an access opening to permit access to one of said tray compartments, said control unit further including means for rotating said carousel tray within said drawer to a selected position aligning a selected one of the tray compartments with said access opening, and means for locking said tray in said selected position when said at least one drawer is moved to the open position.

2. The medication dispenser unit of claim 1 wherein said at least one drawer includes spring means reacting between said drawer and said station housing to bias said drawer toward an at least partially open position when said drawer is unlocked by said control unit.

3. The medication dispenser station of claim 1 wherein said controller means includes means for detecting the rotational position of said carousel tray.

4. The medication dispenser station of claim 3 wherein said tray is rotatably supported upon a turntable having peripheral notches formed therein, said detecting means comprising an optical detector associated with said notches to track the rotational position of said turntable, said turntable and said tray including drive means connected therebetween for supporting said tray in a predetermined rotational position on said turntable and for rotating said tray with said turntable.

5. The medication dispenser station of claim 4 further including a lock pin within said at least one drawer, and means for seating said lock pin into one of said turntable notches when the drawer is moved to the open position to lock said turntable and tray against rotation.

6. The medication dispenser station of claim 5 wherein said seating means includes a spring for urging said lock pin to seat within said one turntable notch, said spring further reacting between said drawer and said station housing to urge said drawer toward an at least partially open position when said drawer is unlocked.

7. The medication dispenser station of claim 1 wherein said carousel tray includes a plurality of removable dividers defining said tray compartments.

8. The medication dispenser station of claim 1 wherein said at least one drawer and said cover plate include interlocking flange means for mounting said cover plate onto said drawer, said control unit lock means further including means for locking said drawer in a partially open position in response to entry of first access data and for permitting said drawer to be fully opened in response to entry of second access data, said cover plate being blocked against removal from said drawer when said drawer is in the partially open position, said cover plate being removable from said drawer when said drawer is fully opened.

9. The medication dispenser station of claim 1 wherein at least one of said drawers includes a partition grid separating the interior of said drawer into a plurality of compartments.

10. The medication dispenser station of claim 1 wherein at least one of said drawers has a plurality of open bins supported therein.

11. The medication dispenser station of claim 1 wherein said control unit further includes means for generating an access record in response to entry of said access data.

12. The medication dispenser station of claim 11 wherein said access record generating means includes a printer.

13. The medication dispenser station of claim 11 wherein said access record generating means includes a disk drive unit.

14. The medication dispenser station of claim 1 wherein said control unit is mounted on said station housing.

15. A medication dispenser station, comprising:

a station housing;

at least one drawer carried by said station housing for movement between on open position and a closed position, said drawer defining a plurality of compartments for containing pharmaceutical items in presorted array, said compartments being accessible to the exterior of said station housing when the drawer is in the open position;

a control unit for selectively locking said drawer in the closed position to prevent access to the drawer compartments, said control unit including keyboard entry means for entry of predetermined access data, lock means for selectively locking and unlocking said drawer, and controller means responsive to entry of said access data to selectively unlock said drawer to permit opening thereof;

said drawer having a carousel tray mounted therein and defining said plurality of said compartments for containing the plurality of pharmaceutical items in a presorted array, and a cover plate mounted on said drawer in a position overlying said tray and defining an access opening to permit access to one of said tray compartments, said control unit further including means for rotating said carousel tray within said drawer to a selected position aligning a selected one of the tray compartments with said access opening, means for locking said tray in said selected position when said at least one drawer is moved to the open position, and means for detecting the rotational position of said carousel tray;

said tray being rotatably supported upon a turntable having peripheral notches formed therein, said detecting means comprising an optical detector associated with said notches to track the rotational position of said turntable, said turntable and said tray including drive means connected therebetween for supporting said tray in a predetermined rotational position on said turntable and for rotating said tray with said turntable; and a lock pin within said drawer, and means for seating said lock pin into one of said turntable notches when the drawer is moved to the open position to lock said turntable and tray against rotation, said seating means including a spring for urging said lock pin to seat within said one turntable notch, said spring further reacting between said drawer and said station housing to urge said drawer toward an at least partially open position when said drawer is unlocked.

16. The medication dispenser station of claim 15 wherein said carousel tray includes a plurality of removable dividers defining said tray compartments.

17. The medication dispenser station of claim 15 wherein said control unit further includes means for generating an access record in response to entry of said access data.

18. A medication dispenser station, comprising:

a station housing;

a plurality of drawers carried by said housing for movement between open and closed positions, said drawers defining a plurality of compartments for receiving and storing pharmaceutical items in a presorted array, said compartments being inaccessible when said drawers are closed;

lock means associated with each of said drawers for individually locking said drawers in the closed position; and a control unit on said housing for operating said lock means to selectively lock and unlock said drawers thereby to control access to items contained therein, said control unit including data entry means for entry of predetermined access data, and controller means responsive to said access data for selectively unlocking said drawers to permit opening thereof;

at least one of said drawers having a carousel tray mounted therein and defining a plurality of said compartments for containing a plurality of pharmaceutical items in a presorted array, and a cover plate mounted on said at least one drawer in a position overlying said tray and defining an access opening to permit access to one of said tray compartments, said control unit further including means for rotating said carousel tray within said drawer to a selected position aligning a selected one of the tray compartments with said access opening, and means for locking said tray in said selected position when said at least one drawer is moved to the open position;

said at least one drawer and said cover plate including interlocking flange means for mounting said cover plate onto said drawer, said control unit further including means for locking said drawer in a partially open position in response to entry of first access data and for permitting said drawer to be fully opened in response to entry of second access data, said cover plate being blocked against removal from said drawer when said drawer is in the partially open position, said cover plate being removable from said drawer when said drawer is fully opened.

19. The medication dispenser station of claim 18 wherein said carousel tray includes a plurality of removable dividers defining said tray compartments.

20. The medication dispenser station of claim 18 wherein at least one of said drawers includes a partition grid separating the interior of said drawer into a plurality of compartments.

21. The medication dispenser station of claim 18 wherein at least one of said drawers has a plurality of open bins supported therein.

22. The medication dispenser station of claim 21 wherein one of said bins includes a one-way cap to permit return of unused pharmaceutical items into said one bin.

23. The medication dispenser of claim 18 wherein said control unit further includes means for generating an access record in response to entry of said access data.

24. The medication dispenser station of claim 23 wherein said access data includes selected information representing said access record.

25. A method of storing and dispensing pharmaceutical items, comprising the steps of:

stocking a plurality of pharmaceutical items in a presorted array into a plurality of drawers adapted for opening and closing movement with respect to a dispenser station housing:

entering predetermined access data into a control unit associated with the dispenser station housing to specify a desired pharmaceutical item stocked within one of the drawers;

normally maintaining the drawers in closed and locked positions to prevent access tot he contents thereof;

unlocking said one drawer in response to said entering step by automatic operation of the control unit, while maintaining the remaining drawers in a locked condition, to permit opening of said one drawer and access to the desired pharmaceutical item therein, while preventing access to the pharmaceutical items in said remaining drawers, at least one of said drawers including a carousel tray with a plurality of tray compartments, the tray being mounted for rotation within said one drawer for rotation beneath an overlying cover plate having an access opening therein, and further including the steps of rotating the tray to align a selected one of the compartments with the cover plate access opening, and locking the tray against further rotation when the drawer is opened; and generating an access record.

* * * * *